US005088450A

United States Patent [19]

Sternfeld et al.

[11] Patent Number: 5,088,450

[45] Date of Patent: Feb. 18, 1992

[54] STEAM GENERATOR

[75] Inventors: Hans Sternfeld, Jagsthausen; Karlheinz Wolfmueller, Eppingen/Adelshofen; Alfred Brunn, Adelsheim-Sennfeld, all of Fed. Rep. of Germany

[73] Assignee: Deutsche Forschungsanstalt fuer Luft- und Raumfahrt e.V., Fed. Rep. of Germany

[21] Appl. No.: 605,802

[22] Filed: Oct. 30, 1990

[30] Foreign Application Priority Data

Nov. 4, 1989 [DE] Fed. Rep. of Germany ..... 3936806

[51] Int. Cl.[5] ..... F22B 1/02

[52] U.S. Cl. ..... 122/31.1; 66/39.55; 431/170

[58] Field of Search ..... 122/31.1; 431/4, 170; 60/39.55

[56] References Cited

U.S. PATENT DOCUMENTS 4,377,067 3/1983 Sternfeld et al. .
4,474,140 10/1984 Sternfeld ..... 122/31.1
4,558,743 12/1985 Ryan et al. ..... 122/31.1 X

FOREIGN PATENT DOCUMENTS 88376 9/1983 European Pat. Off. .
704301 3/1941 Fed. Rep. of Germany .
324895 10/1902 France .

*Primary Examiner*—Edward G. Favors
*Attorney, Agent, or Firm*—Barry R. Lipsitz

[57] ABSTRACT

In a steam generator with a blow-in head through which an oxidizer and a fuel are blown into a combustion chamber adjoining the blow-in head and with injection devices for water leading into the combustion chamber, in order to create optimum conditions in the combustion chamber, it is proposed that the blow-in head have several blow-in elements which blow the oxidizer and the fuel jointly into the combustion chamber and which conduct one of these two in an inner cylinder flow and the other in a ring flow surrounding the inner cylinder flow.

16 Claims, 3 Drawing Sheets

STEAM GENERATOR

Figure 1:
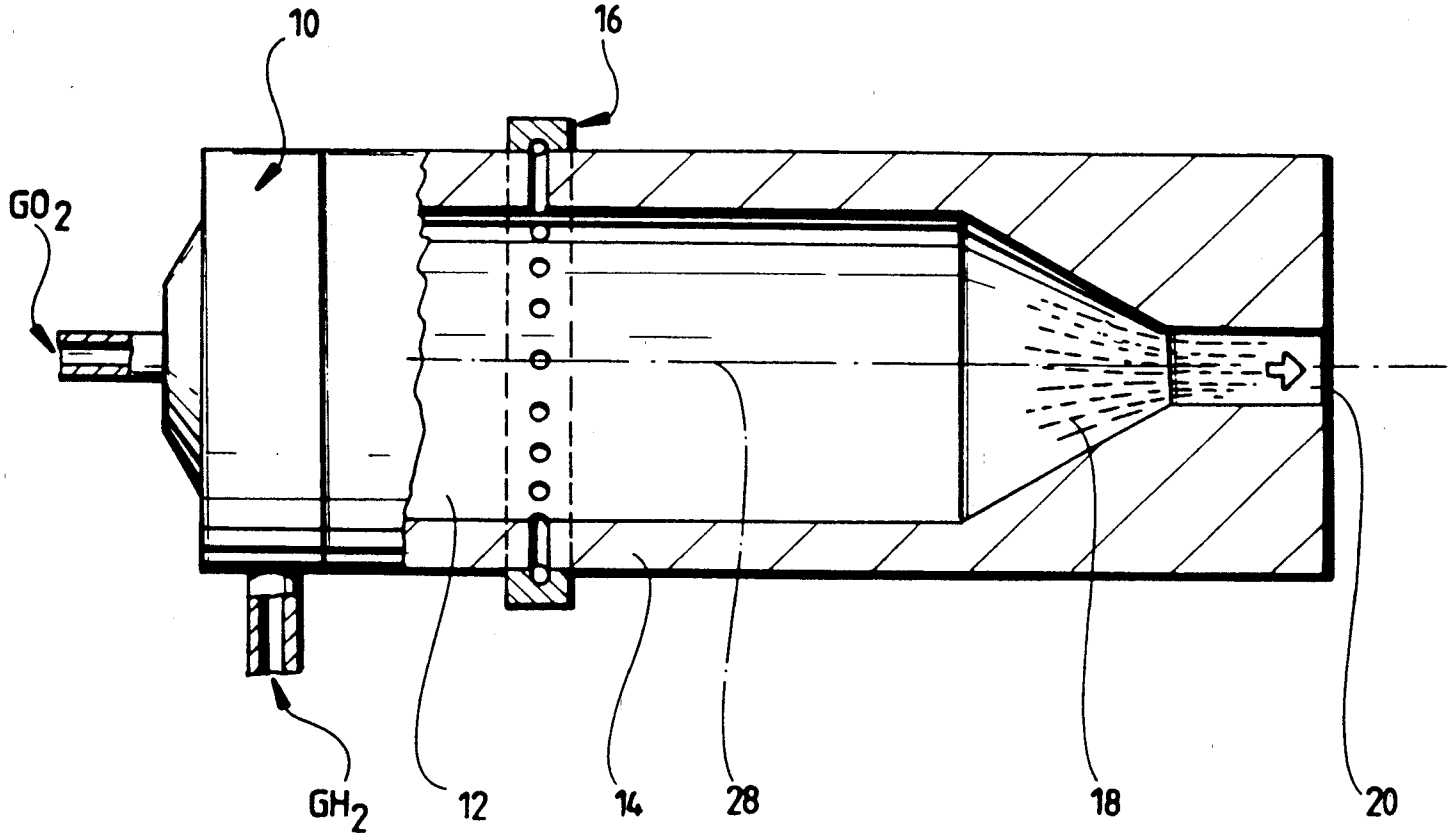

The invention relates to a steam generator, in particular, to a hydrogen/oxygen steam generator with a blow-in head through which an oxidizer and a fuel are blown into a combustion chamber adjoining the blow-in head and with injection devices for water leading into the combustion chamber.

The problem with such steam generators is that of blowing the oxidizer and the fuel into the combustion chamber in a optimum manner so that complete combustion takes place. The oxidizer and the fuel are preferably blown in in stoichiometric ratios with a view to achieving complete combustion.

The object underlying the invention is, therefore, to produce a steam generator of the generic kind wherein optimum combustion conditions are created in the combustion chamber.

This object is accomplished in accordance with the invention with a steam generator of the kind described at the beginning by the blow-in head having several blow-in elements which blow the oxidizer and the fuel jointly into the combustion chamber and which conduct one of these two in an inner cylinder flow and the other in a ring flow surrounding the inner cylinder flow.

The advantage of the inventive solution is that this way of blowing in the oxidizer and the fuel enables reliable and, above all, stoichiometric combustion of these two, which is an absolute necessity particularly when oxygen is used as oxidizer and hydrogen as fuel.

A solution wherein the ring flow and the cylinder flow are blown into the combustion chamber directly by the blow-in element is particularly expedient.

It is, furthermore, advantageous for the ring flow and the cylinder flow to be formed in parallel directions of flow in the blow-in element and blown into the combustion chamber.

In this connection, it has proven particularly favorable for the ring flow to extend coaxially with the inner cylinder flow.

It has, furthermore, proven expedient in connection with the inventive design of the blow-in head for the oxidizer to be conducted in the inner cylinder flow and the fuel in the outer ring flow so the flow of fuel surrounds the flow of oxidizer.

As mentioned at the beginning, the oxidizer is preferably oxygen and the fuel hydrogen, and both are introduced in stoichiometric mass flow ratios.

In connection with the design of the inventive blow-in head, it has proven particularly advantageous for the blow-in elements to be arranged in an inner region of a bottom plate of the blow-in head, with the bottom plate having an edge region free of blow-in elements and enclosing the inner region and this edge region preferably extending as far as a wall enclosing the combustion chamber. Provision of this edge region free of blow-in elements results, in all, in better energy conversion downstream from the blow-in elements and in lower thermal stress on the combustion chamber wall.

Particularly advantageous relations are achieved between the inner region and the edge region by the surface area of the inner region not exceeding 0.6 times the total surface area of the bottom plate, represented by the sum of the surface areas of the inner and edge regions.

In a preferred embodiment, provision is made for the bottom plate to be of circular design. It is thus also expedient for the inner region to be of circular design and the edge region to constitute a circular-ring region surrounding the inner region.

In connection with the design of the blow-in elements, it has, furthermore, proven advantageous for the cross- r sectional area of the cylinder flow to be greater than the cross-sectional area of the ring flow, in particular, in order to achieve good mixing of the fuel and the oxidizer.

Also certain relations between the individual pipes conducting the cylinder flow and the ring flow result in advantageous combustion characteristics of the blow-in elements.

It is particularly advantageous for the length of the inner pipe of the blow-in element generating the cylinder flow to be at least three times its diameter.

In like manner, it has proven particularly expedient as an alternative or in addition to the aforesaid for the length of the circumferential surface of the blow-in element generating the ring flow to be at least three times the "equivalent" or "hydraulic" diameter of the ring flow.

In the description of the embodiments so far, details were only given as to the arrangement of the blow-in elements which supply the oxidizer and the fuel during operation of the steam generator and nothing was said about how ignition of the oxidizer/fuel mixture is to be brought about.

In a particularly preferred embodiment, provision is made for an orifice of an ignition chamber or orifices of several ignition chambers to be arranged in the edge region of the bottom plate. Consequently, the ignition chambers lie outside of the region in which the blow-in elements provided for operation of the steam generator are arranged and the blow-in elements can, therefore, be arranged in an optimum manner without having to take the ignition chambers into consideration.

Several ignition chambers are preferably provided in order to achieve uniform ignition.

While in the case of the blow-in elements, provision is made for these to blow the oxidizer and the fuel into the combustion chamber such that these only mix fully in the combustion chamber, provision is made, in contrast therewith, in the case of the ignition chambers, for the oxidizer and the fuel to be mixed to an ignitable mixture therein.

The ignition chamber is preferably designed such that the oxidizer introduced in an inner cylinder flow and the fuel introduced in a ring flow surrounding the inner cylinder flow are fully mixed in an ignition area before emerging from the bottom plate.

It is expedient for the ignition area to be arranged so as to adjoin an inner cylinder pipe generating the inner cylinder flow.

It is also expedient for the ignition area to be arranged so as to be bounded by the continuation of the circumferential surface delimiting the ring flow outwardly.

An igniter element is preferably provided in the ignition area for igniting the mixture of oxidizer and fuel. In particular, the igniter element is arranged immediately before the orifice.

Figure 2:
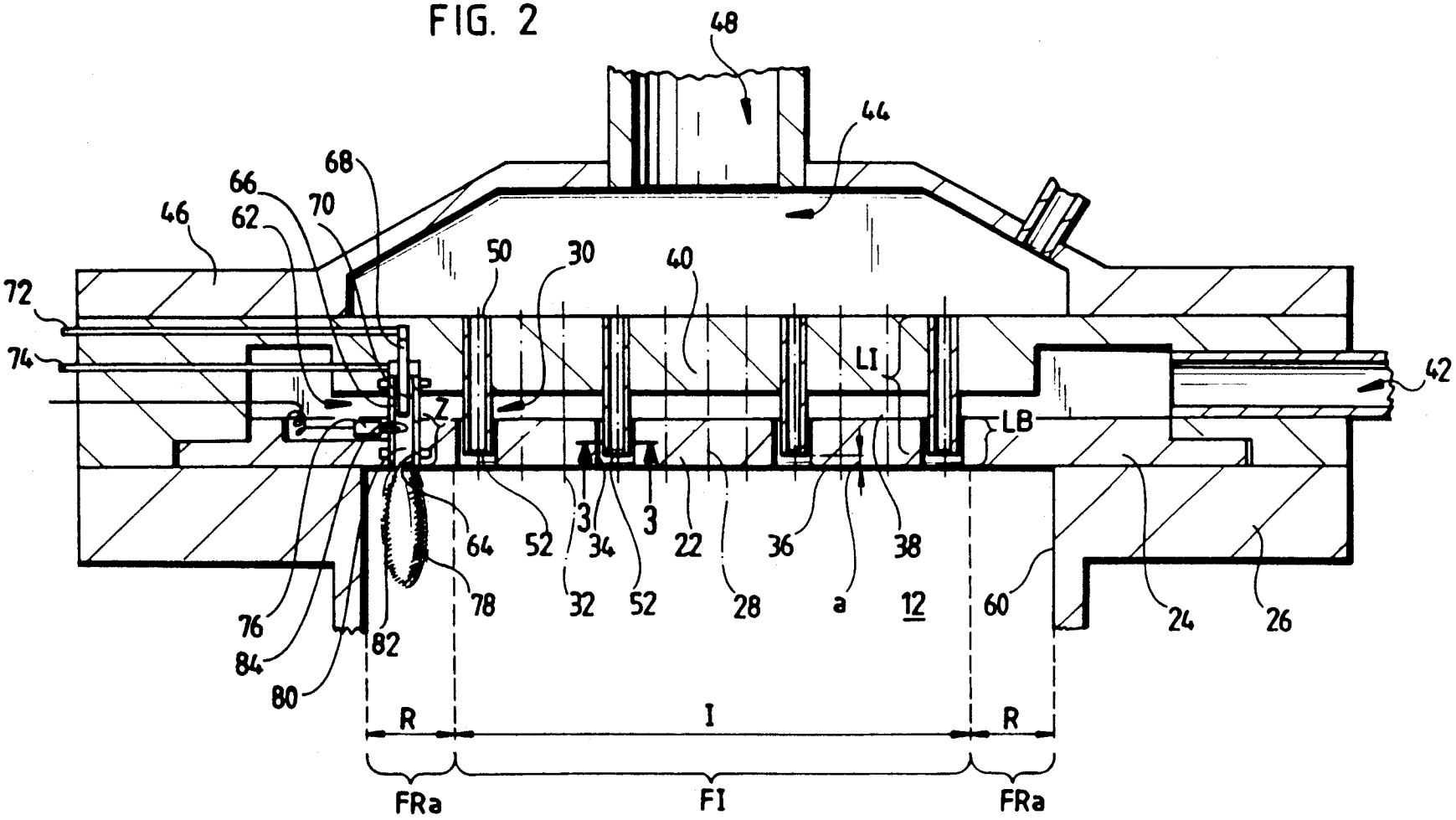

Further features and advantages of the invention are set forth in the following description and the appended drawings of an embodiment. The drawings show:

FIG. 1 a partial, longitudinal section through a schematically illustrated embodiment of an inventive steam generator;

FIG. 2 an enlarged illustration of a blow-in head; and

Figure 3:
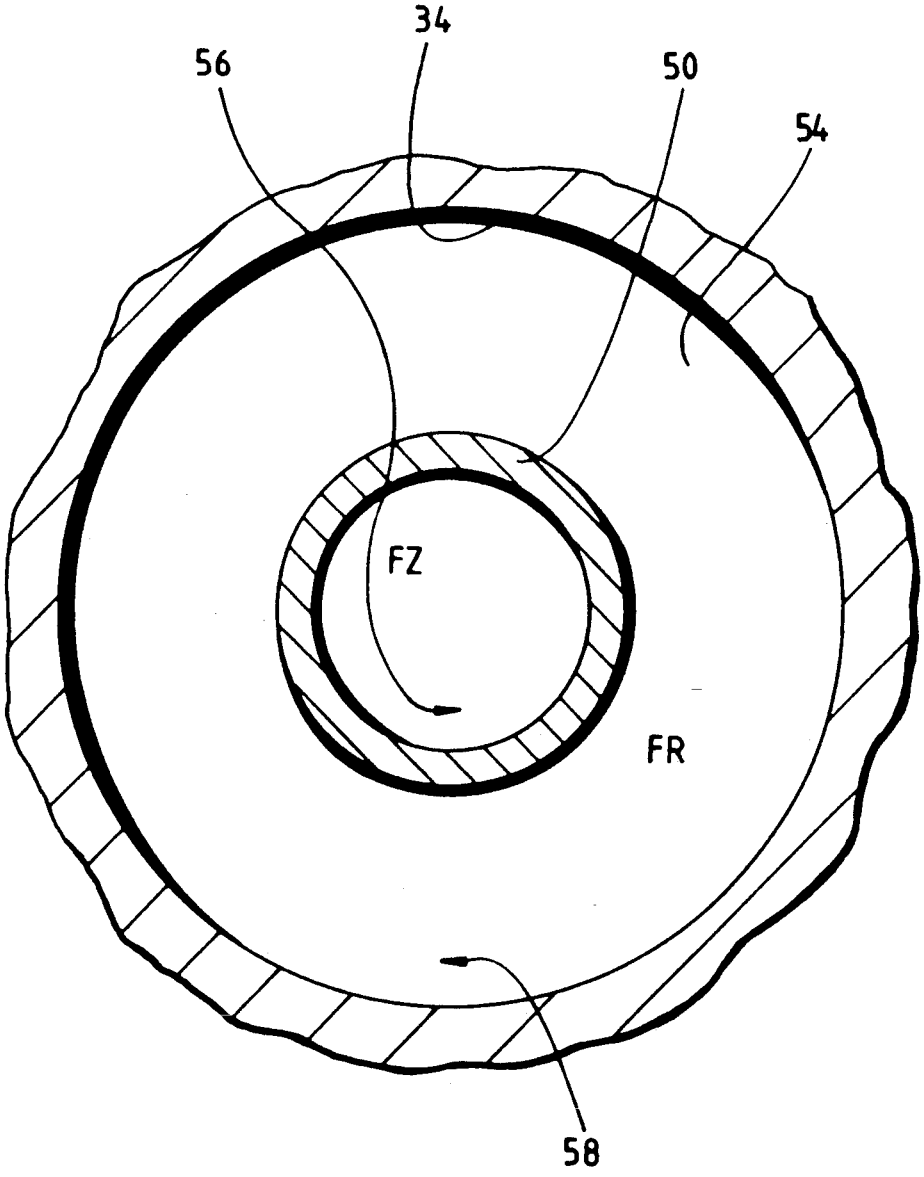

FIG. 3 a section along line 3—3 in FIG. 2.

An embodiment of an inventive steam generator, illustrated in FIG. 1, comprises a blow-in head 10 with an adjoining combustion chamber 12 surrounded by a combustion chamber housing 14. Arranged in this combustion chamber housing in spaced relation to the blow-in head 10 are several—at least one—injection rings 16 with which water is injected into the combustion chamber so as to generate at an end opposite the blow-in head 10 a vapor stream 18 which emerges from the steam generator through an outlet opening 20. The inventive embodiment is preferably operated as hydrogen/oxygen steam generator wherein a flow of oxygen $GO_2$ and a flow of hydrogen $GH_2$ are supplied in stoichiometric ratios to the blow-in head 10 which then blows the two flows into the combustion chamber 12.

As illustrated in FIG. 2, the blow-in head designated in its entirety 10 closes off the combustion chamber 12 and forms a bottom plate 22 which rests with an outer bearing edge 24 against a terminating flange 26 of the combustion chamber housing 14 and extends in a plane extending perpendicularly to a longitudinal axis 28 of the combustion chamber housing.

In a preferably circular, inner region I extending concentrically around the longitudinal axis 28, the bottom plate 22 is provided with a plurality of blow-in elements designated in their entirety 30 which are aligned with a longitudinal axis 32 parallel to the longitudinal axis 28 of the combustion chamber housing. The blow-in elements 30 are preferably arranged in a regular pattern in the inner region I and exhibit substantially constant spacings from one another.

Each of these blow-in elements 30 comprises a bore 34 extending from a front side 36 of the bottom plate 32 facing the combustion chamber 12 through the bottom plate 22 in the direction away from the combustion chamber 12 as far as a hydrogen distribution area 38. The blow-in elements 30 also have an inner pipe 50 which will be described hereinbelow. The hydrogen distribution area 38 is formed by a space between the bottom plate 22 and an intermediate bottom 40 arranged parallel to the bottom plate 22 on the side opposite the combustion chamber and in spaced relation thereto. The hydrogen mass flow $GH_2$ is preferably supplied in an outer region of the hydrogen distribution area 38, in particular through a hydrogen feed pipe 42 extending in the radial direction in relation to the longitudinal axis 28 and leading into the hydrogen distribution area 38.

On the side of the intermediate bottom 40 opposite the hydrogen distribution area 38 there is an oxygen distribution area 44 formed, on the one hand, by the intermediate bottom 40 and, on the other hand, by a rear cover 46 of the blow-in head 10. An oxygen feed pipe 48 leads into this oxygen distribution area 44.

In addition to the bore 34, the blow-in elements 30 comprise the inner pipe 50 which penetrates the intermediate bottom 40. The inner pipe 50 extends from the oxygen distribution area 44 in the direction of the combustion chamber 12 and opens within the bore 34 with a front end 52 which is located at a spacing a behind the front side 36 of the bottom plate 22.

The inner pipe 50 is aligned coaxially with the longitudinal axis of the respective blow-in element 30 and has an outer diameter which is smaller than the inner diameter of the bore 34 so a ring gap 54 remains between the inner pipe 50 and the bore 34, as illustrated in FIG. 3.

As the inner pipe 50 proceeds from the oxygen distribution area 44, a cylinder flow 56 of oxygen gas flows through this inner pipe 50 and emerges from this inner pipe 50 at its front end 52.

As the bore 34 extends as far as the hydrogen distribution area 38 which is, however, penetrated completely by the inner pipe 50, a ring flow 58 of hydrogen gas flows in the ring gap 54 between the inner pipe 50 and the bore 34 and separately around the cylinder flow 56 as far as the front end 52 of the inner pipe 50 and so both flows in the blow-in element 30 can only mix from the front end 52 of the inner pipe onwards. Since the front end 52 is arranged at a spacing a from the front side 36 of the bottom plate 22, mixing of the ring flow 58 with the cylinder flow 56 already starts to a slight extent before the front side of the bottom plate 22 and then continues to an increased extent into the combustion chamber 12 where it takes place fully.

In accordance with the invention, the cross-sectional area FZ made available for the cylinder flow is larger than the cross-sectional area FR made available for the ring flow. Also, the condition must always be met that oxygen and hydrogen are blown in together in stoichiometric ratios.

In addition, in accordance with the invention, the length LI of the inner pipe 50 is greater than three times the diameter of the inner pipe.

Furthermore, in accordance with the invention, the length LB of a circumferential surface of the bore 34 is selected such that it is greater than three times the "equivalent" or "hydraulic" diameter of the ring flow 58, this "equivalent" or "hydraulic" diameter being calculated in accordance with the formula $D=4FR/U$, where U is the circumference of the flow cross-section of the ring flow 58.

The inner region I of the bottom plate 22 which is provided with the blow-in elements 30 is also surrounded by an edge region R which encloses the inner region I in circular-ring configuration and extends as far as an inner wall surface 60 of the combustion chamber housing 14. In accordance with the invention, this edge region R is not provided with blow-in elements 30.

The edge region R preferably comprises ignition chambers 62 which extend from the bottom plate 22 in the opposite direction to the combustion chamber 12 and open with their front orifice 64 in the front side 36 of the bottom plate 22.

The ignition chambers 62 comprise an encasing pipe 66 forming an outer wall of the latter as well as a cylinder pipe 68 arranged coaxially in this encasing pipe 66. The cylinder pipe 68 forms between an inside wall of the encasing pipe 66 and its own outside wall a ring area 70. A rear end of the cylinder pipe 68 is connected to an oxygen feed pipe 72, while a rear end of the ring area 70 is connected to a hydrogen feed pipe 74 and so a cylinder flow of oxygen is likewise surrounded by a ring flow of hydrogen.

The cylinder pipe 68 preferably terminates at a spacing Z from the orifice 64 so the ring flow of hydrogen can mix completely with the cylinder flow of oxygen in the ignition chamber 62. An electric igniter 76 is preferably provided between the end of the cylinder pipe 68 and the orifice 64 to ignite the ring flow of hydrogen mixed with the cylinder flow of oxygen before the orifice 64 and so a burning jet 78 of hydrogen and oxygen emerges from the orifice 64 in the bottom plate 22 and is then able to ignite the hydrogen/oxygen flows emerging from the inner region I of the bottom plate 22.

To this end, there is preferably formed between the front end of the cylinder pipe 68 and the orifice 64 an ignition area 80 which exhibits the length Z and extends between the front end of the cylinder pipe 68 and the orifice 64. The ignition area is preferably delimited by an inner circumferential surface 82 of the encasing pipe 66 which likewise contributes to the formation of the ring flow in the region between the encasing pipe 66 and the cylinder pipe 68 and continues as far as the orifice 64. An igniter head 84 of the igniter element 76 expediently protrudes beyond this inner circumferential surface and is arranged in a region in which the oxidizer and the fuel are fully mixed, preferably immediately before the orifice 64.

An igniter plug or a glow plug is preferably provided as igniter element.

In the inventive blow-in head, the surface area FI of the inner region is preferably selected such that it is smaller than or equal to 0.6 times the surface area FI+-FRa, i.e., the sum of the surface area of the inner region FI and the surface area of the edge region FRa.

The present disclosure relates to the subject matter disclosed in German application No. P 39 36 806.8 of Nov. 4, 1989, the entire specification of which is incorporated herein by reference.

What is claimed is:

1. Steam generator comprising a blow-in head through which an oxidizer and a fuel are blown into a combustion chamber adjoining said blow-in head, and injection devices for water leading into said combustion chamber, said blow-in head having several blow-in elements which blow said oxidizer and said fuel jointly into said combustion chamber and having means for conducting one of these two in an inner cylinder flow and the other in a cylindrical ring flow surrounding said inner cylinder flow, wherein said oxidizer and fuel are arranged as concentric cylinders when they enter said combustion chamber.

2. Steam generator as defined in claim 1, characterized in that said oxidizer is conducted in said inner cylinder flow and said fuel in said cylindrical ring flow.

3. Steam generator as defined in claim 1, characterized in that said blow-in elements are arranged in an inner region of a bottom plate of said blow-in head, said bottom plate having an edge region which is free of blow-in elements and encloses said inner region.

4. Steam generator as defined in claim 3, characterized in that the surface area of said inner region is less than 0.6 times the total surface area of said bottom plate, represented by the sum of the surface areas of said inner region and said edge region.

5. Steam generator as defined in claim 1, characterized in that the cross-sectional area of said cylinder flow is larger than the cross-sectional area of said cylindrical ring flow.

6. Steam generator as defined in claim 1, characterized in that the length of an inner pipe of said blow-in element generating said cylinder flow is at least approximately three times its diameter.

7. Steam generator as defined in claim 1, characterized in that the length of a circumferential surface of said blow-in element generating said cylindrical ring flow is at least approximately three times the "equivalent" or "hydraulic" diameter of said ring flow.

8. Steam generator as defined in claim 1, characterized in that an orifice of an ignition chamber is arranged in an edge region of said bottom plate.

9. Steam generator as defined in claim 8, characterized in that several ignition chambers are provided.

10. Steam generator as defined in claim 8, characterized in that said ignition chamber is designed such that said oxidizer and said fuel are mixed to an ignitable mixture.

11. Steam generator as defined in claim 10, characterized in that said ignition chamber is designed such that said oxidizer introduced in an inner cylinder flow and said fuel introduced in a cylindrical ring flow surrounding said inner cylinder flow are mixed in an ignition area before emerging from said bottom plate.

12. Steam generator as defined in claim 11, characterized in that said ignition area adjoins an inner cylinder pipe generating said inner cylinder flow.

13. Steam generator as defined in claim 11, characterized in that said ignition area is bounded by the continuation of the circumferential surface delimiting said cylindrical ring flow outwardly.

14. Steam generator as defined in claim 8, characterized in that an igniter element is arranged in said ignition area.

15. Steam generator as defined in claim 14, characterized in that said igniter element is arranged immediately before said orifice.

16. A steam generator comprising:

a blow-in head through which an oxidizer and a fuel are blown into a combustion chamber adjoining said blow-in head; and injection devices for water leading into said combustion chamber;

said blow-in head having:

several blow-in elements which blow said oxidizer and said fuel jointly into said combustion chamber, a cylindrical channel for conducting one of the oxidizer and fuel into an inner cylinder flow, and a cylindrical ring channel surrounding said cylindrical channel for conducting the other of said oxidizer and fuel into a ring flow surrounding said inner cylinder flow, wherein said oxidizer and fuel are arranged as concentric cylinders when they enter said combustion chamber.

* * * * *